United States Patent [19]

Matschke

[11] 4,134,691

[45] Jan. 16, 1979

[54] PRINTING HEAD

[75] Inventor: Arthur L. Matschke, Westport, Conn.

[73] Assignee: Matschke General Research Company, Inc., Westport, Conn.

[21] Appl. No.: 815,718

[22] Filed: Jul. 14, 1977

Related U.S. Application Data

[63] Continuation of Ser. No. 646,626, Jan. 5, 1976, abandoned.

[51] Int. Cl.[2] ..... B41J 3/12

[52] U.S. Cl. ..... 400/124; 101/93.05

[58] Field of Search ..... 197/1 R; 101/93.28, 101/93.29, 93.32–93.34, 93.05; 335/258, 270, 274; 400/124

[56] References Cited

U.S. PATENT DOCUMENTS

| | | | |
|---|---|---|---|
| 3,335,659 | 8/1967 | Schacht et al. | 101/93.34 X |
| 3,467,232 | 9/1969 | Paige | 197/1 R |
| 3,842,737 | 10/1974 | Gomi | 101/93.34 |
| 3,842,955 | 10/1974 | Iwasaki | 197/1 R |
| 3,897,865 | 8/1975 | Darwin et al. | 197/1 R |
| 3,994,381 | 11/1976 | Hebert | 197/1 R |

FOREIGN PATENT DOCUMENTS

| | | | |
|---|---|---|---|
| 2119641 | 11/1972 | Fed. Rep. of Germany | 197/1 R |

*Primary Examiner*—Paul T. Sewell

*Attorney, Agent, or Firm*—James J. Burke, II

[57] ABSTRACT

A printing head for dot matrix printers, including novel electromagnet structures for driving individual printing wires. In each electromagnet, a pair of coils generally radial to the printing wire axis drive an armature coaxial with the printing wire and to which it is attached. The head is specifically designed for simple and reliable construction at low cost, operation at moderate speeds (60–100 cps) for extended periods with a long, powerful stroke, and includes high-reliability mounting elements for the print wire and armature, where problems have been experienced with prior art designs.

13 Claims, 6 Drawing Figures

PRINTING HEAD

This is a continuation of application Ser. No. 646,626, filed Jan. 5, 1976 now abandoned.

BACKGROUND OF THE INVENTION

1. Field of the Invention

The present invention relates generally to printing heads for dot matrix printers and, more particularly, it relates to electromagnet designs for use therein.

In dot matrix printers, printing is accomplished by driving selected printing wires in an array of printing wires against a printing surface, typically an inked ribbon adjacent a paper-bearing platen. The individual printing wires are energized by means of solenoids or electromagnets, and during each printing stroke a spring element is tensioned, which pulls the printing wire back to its rest position at the completion thereof. An array of printing wires may produce a complete printed character with each energization of selected members thereof, in which case a 7×5 array of 35 wires is typical. Alternatively, the array may comprise a single vertical row of 6–9 wires, in which case successive energization of selected members of the array are required to complete a character. In all cases, of course, the printing head moves so that characters are printed in proper sequence, in seriatim. The head may index from one position to the next in the manner of a typewriter carriage, but in modern matrix printers it is more common for the printing head to move continuously in a horizontal plane, printing "on the fly".

The printing head is a housing having an aperture adjacent the printing face where the printing wires are arranged in the desired array. Within the housing, means are provided to guide the wires, from the respective solenoids or electromagnets to the aperture. The housing also serves as a mount for these driving elements.

Because the aperture is small, being the size of a printed character or a fraction thereof, and the driving elements are relatively large, printing heads tend to be cone-shaped, with the drive elements in the base of the cone at an angle to the printing axis. Thus, the printing wires must curve through that angle to arrive at the aperture and printing face in the printing axis. Since this means that the wires will be rubbing against the guiding means, generating heat and wear and reducing power delivered as printing stroke, it is desireable to keep this angle as small as possible. Further, in prior printing heads there has been an inherent change in the wire angle as the stroke proceeds, which can set up undesired oscillations and introduce axial stresses.

The drive elements always include a core for a winding or coil, with pole pieces for confining and concentrating the magnetic field, and an armature that moves in response to the magnetic field, thus driving the print wire.

Of the many trade-offs facing the designer of a matrix printer, those involving speed and power are the most vexing. Higher speeds are possible with heads of lower mass, but a 7 × 1 head must print five times to form a character, as opposed to once on a 7 × 5 head. As speed increases, recoil times, pulse shape and many other factors become more critical. A high-powered printing stroke is desired, for example, when several copies are to be printed at once. To do this, larger coils may be provided in the drive elements, but these tend to produce more heat, and they may develop cross-talk problems because of the stronger magnetic fields involved. Thus, spacing between drive elements becomes more critical, with a consequent effect on the mass of the head.

It is the natural tendency of any piece of machinery, in operation, to tear itself to pieces, starting with the weakest part, and this is particularly true of matrix printing heads, where two of the generally desired goals are high speed and low mass. The anchoring of a print wire into the armature of the driving element is one place where failures have been frequent. The printing wire may be a tungsten alloy or other very hard material, and the armature must be a magnetic material. Such materials are difficult to weld under any circumstances, much less to each other. A similar problem exists in attaching the spring means to the armature, where that is necessary (i.e. where the stored spring energy is tensional rather than compressive).

Long before a printing head self-destructs, of course, there will be wear, and any parts that can become improperly aligned will do so. This requires frequent maintenance or, in its absence, more extended downtime for repairs.

2. Prior Art

Understanding of the present invention will be facilitated by considering some recent prior art patents in the field. Where these patents have features in common with the present invention this is pointed out.

In U.S. Pat. No. 3,782,520 and No. 3,833,105 a 7 × 1 solenoid-driven printing head is disclosed, and it is one that has achieved significant commercial success. The armatures and printing wires are coaxial, which provides a powerful stroke. This feature is also included in the present invention. The coils are also coaxial with the wires and the armatures, however, and their geometry and structure require that the space between the solenoids be large, with the result that the angle between the printing axis and the armature axis is not constant, and head geometry is considerably enlarged. U.S. Pat. No. 3,802,543 discloses a jeweled nose-bearing aperture for the print wires of the previously-noted patents, and which would be incorporated with equal effect in the present invention.

In U.S. Pat. No. 3,904,011 and No. 3,836,880 there is disclosed a 7 × 5 printing head and an electromagnet therefor, where the angle between the printing axis and the printing wires is minimized, but it is, again, not constant, with the same resulting variables in wire path. The patents disclose arrays of electrogmagnets radially mounted in two planes of 18 and 17 respectively, with extensions on the armatures extending toward and very close to the printing axis, the printing wires being attached to the tips of these extensions at a 90° angle. Because of this mounting, some power is lost in transmission to the printing face because of angular change and resulting distortion during the stroke.

U.S. Pat. No. 3,335,659 discloses a drive element for a hammer or character printer rather than a matrix printer, but which is nevertheless of interest. In a printer of this type the electromagnet drives a single hammer once to produce each character. The characters may be on a revolving type drum or on a passing chain. In either case, the hammer presses the character and the paper together (with an inked ribbon or whatever in-between) and a character is produced. Design considerations of a drive element for this kind of printer are entirely distinct from a matrix printer, of course, since only one is required. Power is necessary and speed is desired. To this end, the patentees disclose two U-shaped cores, each with a pair of coils, and four inclined pole faces. The armature has four mating pole faces and is on a flexure mounting on the side opposite the pole faces. The hammer is secured to the armature. This structure is said to be capable of both power and high speed. It is of interest to the present invention because of the U-shaped core, the inclined pole faces and flexure mounting of the electromagnet.

A drive element of minimal mass and less than 0.2 in. cross-section is disclosed in U.S. Pat. No. 3,745,497, the thin construction being adapted for a line printer. A high speed hammer with windings on the armature as well as the core is disclosed in U.S. Pat. No. 3,711,804.

The prior art is significantly vague or even silent on structure adapted to insure easy maintenance and long life; the skilled practitioner can study the above-referenced literature and readily determine potential problem areas; as noted hereinabove, the joinder of dissimilar materials is the frequent locus of life-limiting disorders.

OBJECTS OF THE INVENTION

A general object of the present invention is to provide an improved printing head for a dot matrix printer.

Another object of the present invention is to provide a printing head for a dot matrix printer having no parts subject to sliding wear.

A further object of the present invention is to provide a printing head for a dot matrix printer wherein printing wire bends are minimized, and the armature center of mass and the print wire are coaxial.

Still another object of the present invention is to provide a printing head for a dot matrix printer having a low mass, a long stroke, substantial power, and a speed capability in the 160–170 character-per-second range.

Still another object of the present invention is to provide a printing head for a dot matrix printer wherein each printing stroke is carried out without angular displacement.

A still further object of the present invention is to provide a dot matrix printing head wherein print wire mounting problems are eliminated, and adjustment is simple and positive.

Yet another object of the present invention is to provide a novel electromagnet for use in a dot matrix printing head capable of achieving the foregoing objects.

Various other objects and advantages of the invention will become clear from the following description of embodiments thereof, and the novel features will be particularly pointed out in connection with the appended claims.

THE DRAWINGS

Reference will hereinafter be made to the accompanying drawings, where:

DESCRIPTION OF EMBODIMENTS

Figure 1:
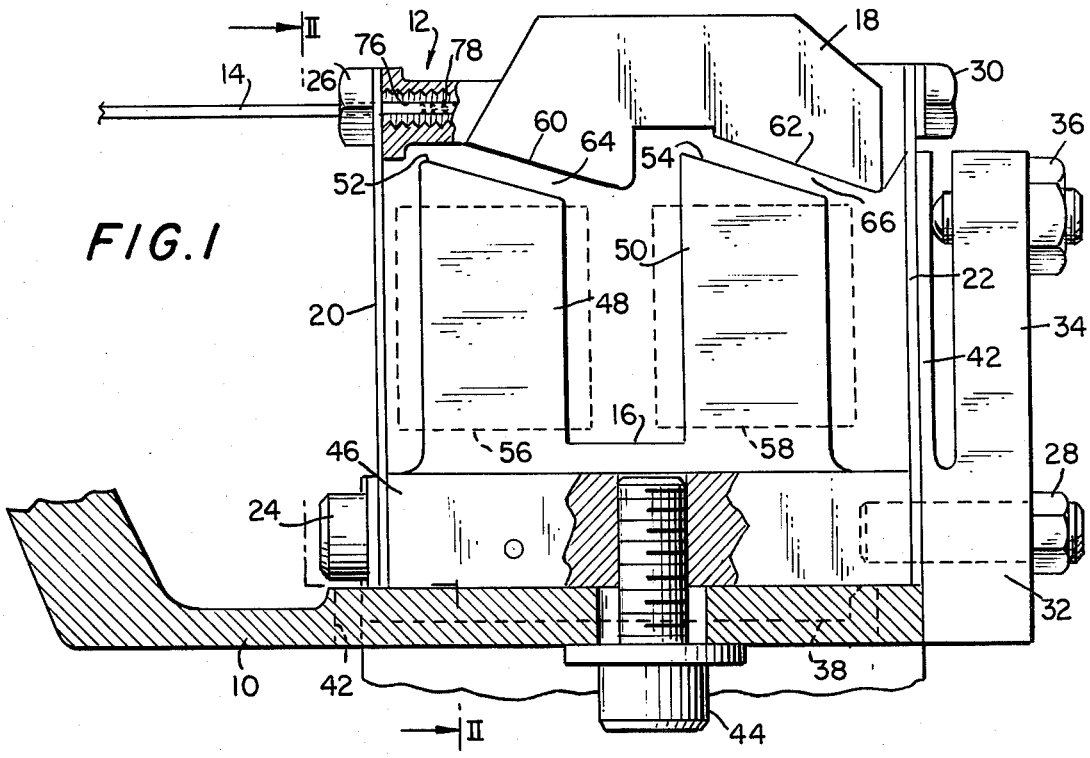
FIG. 1 is an elevation view, partly in section, of an electromagnet assembly in accordance with one embodiment of the invention.

With reference to FIG. 1, the printing head of the present invention comprises a housing or mount 10 supporting a plurality of electromagnet assemblies 12, each of which drives a printing wire 14. Broadly, assemblies 12 each comprise a U-shaped magnetic pole piece 16, an armature 18 secured by machine screws 24, 26, 28, 30, and an L-shaped aluminum saddle 32 secured to mount 10 with screw 28, and including a brace 34 supporting a tension and stroke adjusting screw 36, and a downwardly-extending keel 38 which cooperates with a slot 40 (FIG. 2) in housing 10. Saddle 32 also includes an integral, upstanding and flexible tab 42 which bears against flexure 22 on its forward side and is adjusted for position by screw 36 bearing on the opposed surface of same. Assembly 12 is secured to housing 10 with a further machine screw 44.

Figure 2:
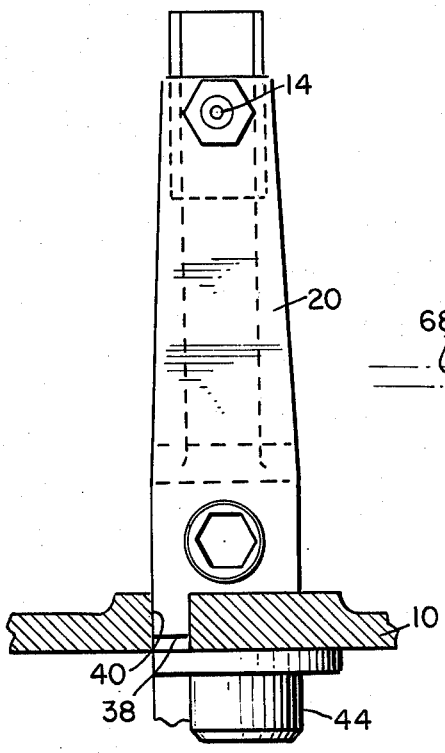
FIG. 2 is an end view of the FIG. 1 assembly, taken along line II—II of FIG. 1.
Figure 3:
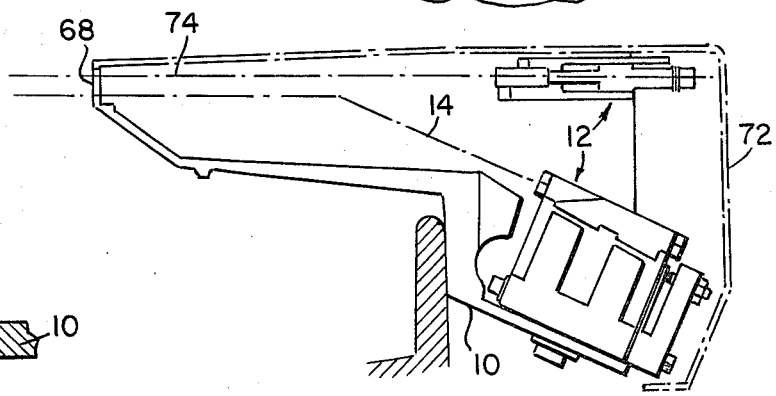
FIG. 3 is a cross-sectional view of the printing head assembly, including plural electromagnets.

Electromagnet assemblies 12 will now be considered in more detail, with general reference to FIGS. 1–3. Pole piece 16 comprises a narrow, rectangular base 46 and two integral, upstanding winding cores 48, 50 having parallel but inclined pole faces 52, 54. The pole piece 16 is constructed of a suitable magnetic material, either monolithic or laminated. The dimensions of base portion 46 are sufficient only to support cores 48, 50 and the screws; in a preferred embodiment, base 46 measures $0.240 \times 0.940 \times 0.180$ in. The winding cores 48, 50 provide a constant magnetic path cross-section and preferably have rectangular cross-sections with rounded corners, adapted to receive pre-wound windings 56, 58 (shown in phantom), as winding coils directly onto such cores would be difficult and expensive. Preferred dimensions for cores 48, 50 are approximately $0.125 \times 0.230$ inch.

Armature 18 has a pair of pole faces 60, 62, of similar dimension and ramp angle as faces 52, 54 of cores 48, 50, which define therebetween a pair of air gaps 64, 66. Armature 18 is, of course, also constructed of magnetic material, and must have a sufficient mass to provide desired printing stroke power, which in a preferred embodiment is about 1.8 grams or less, and which should have the center of mass in the same axis as print wire 14, attached thereto with machine screw 26 in a manner hereinafter described.

Armature 18 is held in the position shown in FIG. 1, which is the rest or unenergized position, by flexure springs 20, 22, which are secured thereto by machine screws 26, 30. At their opposite or base ends, flexures 20, 22 are secured to the base 46 with machine screws 24, 28.

While the base portion 46 is secured to housing 10 by means of machine screw 44, certain important mounting and adjustment functions are carried out by the saddle 32. As shown in FIGS. 1 and 2, saddle 32 is L-shaped and is secured against the rear face of base portion 46 by machine screw 28, with flexure 22 clamped therebetween. It will be appreciated that saddle 32 will be preferred in some embodiments in a general U-shape, with the respective leg portions secured to base 46 at both ends (i.e., with machine screws 24 and 28). Saddle 32 is fabricated from a suitable non-magnetic material such as aluminum or magnesium.

On the "long" side of saddle 32, which is the side parallel with and adjacent to the long side of base portion 46, a keel section 38 extends downwardly into a closely-fitting slot 40 machined into housing 10. With machine screw 44 loosened, this permits sliding adjustment of electromagnet assembly 12 for rapid and precise alignment of the printing face (not shown) of print wire 14.

Saddle 32 also includes an integral, upstanding brace 34 having, at its upper end, a tension and stroke adjust screw 36, and a flexible tab 42. Tab 42 may be integral with saddle 32 or it may be retained in a slot (not shown) machined in the forward place thereof and retained by screw 28, as is flexure spring 22. By itself, tab 42 is parallel and adjacent one surface of flexure spring 22, and acts as a damper for armature 18 on the return (unenergized) stroke to the rest position. In combination with set screw 36, which bears against the opposite or rear side of tab 42, it can be employed to impart a slight pre-tension to flexures 20 and 22. This is important for reliable operation and "fine tuning" of the head, and also mitigates against any fluttering of the flexures. The latter is not considered a problem in known embodiments because the unsupported length of flexures 20,22 is less than about 0.750 in.; in considerably larger units, or where as heretofore a flexure has been used to drive a print hammer a substantial distance, it could be a problem. A further important feature is that tab 42, which acts as a damper, lie on the vertical plane of and be adjacent the vertical rest position of flexure 22 or, as noted above, through adjustment of set screw 36, apply a slight pre-tension thereto. Heretofore, it has been conventional to utilize a block of silicone rubber or the like as a damper on the armature recoil, i.e. such a block would be impinged on by machine screw 30 on armature 18. This is deemed unsatisfactory as it could set up reverse stresses in flexure 22. This can be particularly troublesome at 500–600 cycles per second, the speed required in a printer of the type described to produce 100 characters per second. In a hammer printer, on the other hand, one cycle produces one character so this may not be a problem.

As those familiar with flexure-type mountings will appreciate, parallel, flexible bands 20, 22 permit oscillation in a single plane only, in this case the left-right plane of FIG. 1. Further, because of the rigid mounting of these bands against coplanar surfaces of the respective armature 18 and base portion 46, there is no pivotal movement of the one body with respect to the other; rather, bands 20, 22 flex into a general S-shape curve, the flexure commencing at the middle thereof. More important, flexure does not change the angle of print wire to the print axis at all, and vertical displacement is less than the radius of the wire. For purposes of the present invention, wherein desired printing stroke is generally in the range of 0.040 to 0.085 in., it can be considered that this flexure is essentially without friction, and is power-consuming to a limit defined by the spring-constant of the material.

In operation, the magnetic fields generated by coils 56, 58 in cores 48, 50 will generate a force on armature 18 toward the left, to close air gaps 64, 66. On one hand, the force will be greatest at the moment of energization, when the air gap is greatest, and will decrease as the respective faces come into registration. However, at the same time, the flux lines of force die normal to the pole faces, which are inclined with respect to the armature axis, and the component thereof in the armature axis (which is the same as the print axis) increases as the air gap decreases, adding power to the printing stroke. These two forces, acting concurrently and additively during a printing stroke, result in a more constant-powered stroke at no sacrifice in printing speed.

More particularly, the magnetic field generated by the activated coils on the core exerts a force on the printwire bearing armature in the direction toward the printing plates. The particular value chosen for the ramp angle affects the magnitude of this force in two ways: First, for a predetermined stroke length, or compensation, and for every value of the ramp angle there is a corresponding value of the distance between the pole faces of the armature and core required to accommodate said compensation. This distance, referred to as the "gap length," is a geometric function of the ramp angle and increases with it. Since the magnetic force exerted by the core upon the armature is inversely proportional to the distance separating them, then an increase in the ramp angle results in a decrease in the total magnetic force exerted on the armature.

Second, the choice of ramp angle also determines what proportion of the total magnetic force generated is usable, i.e., parallel to the direction of motion of the armature. Since the magnetic field lines are, throughout the motion of the armature, approximately perpendicular to the planes described by the pairs of pole faces, and since the forces generated by such magnetic lines are everywhere parallel to the lines, then the more nearly perpendicular to the direction of motion of the armature the pole faces are, i.e., the greater the ramp angle, then the greater the degree of parallelism between the generated lines of force and the direction of motion of the armature, and the larger the proportion of the total force which is applied to accelerating the armature.

The foregoing considerations, in optimum balance, indicate that the ramp angle should be in the range of 7° to 26°, and preferably 10° to 15°, for most efficient use of the coil energy.

It is to be emphasized that the flexure mounting of armature 18, with flexures 20, 22 rigidly secured against coplanar surfaces so that flexural bending commences in the center, is a feature of the present invention which contributes to long life and reliable operation of the invention.

One of the operational difficulties that has prevented some matrix print heads from achieving their full potential is a delay in the return of the armature to its rest position after completion of its forward printing stroke. When power to the coils is cut off, the flux field collapses over a finite period of time, generally along the "backside" of the hysteresis curve for the system involved. Such curves, however, are both material-sensitive and geometry-sensitive, and where this is not properly taken into account, the armature will tend to "hang up" against the pole face, gravely affecting available printing speed.

Consideration of materials indicates that the "super" magnetic alloys should be avoided. While they do generate a higher flux density per unit of pulse power, they have a significantly longer die-away time. This "powers" the armature for a longer period than desired, and slows printing.

Geometric considerations are more complex. More important, while the geometries discussed hereinbelow are believed to be generally applicable to electromagnets of the same general type, they were specifically adopted for a preferred embodiment of the invention, i.e., for a stroke length in the range of 0.040–0.085 in., operation in the range of 330 to 650 cycles per second, and an armature of about 1.1 gm.

Figure 1A:
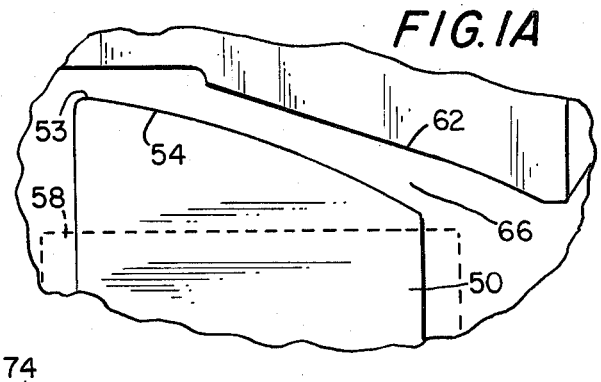
FIG. 1A is an enlarged section of a core pole face of the FIG. 1 assembly.

With this in mind, attention is directed at FIG. 1A, which is an enlarged view of the top of a core 50 showing a pole face 54 and armature face 62 in greater detail. It will first be noted that there is a small 45° bevel 53 at the top of the ramp. This is believed to act as a flux-leakage break. It does not affect the initial force of the pole face on the armature, but were bevel 53 not present, that portion of the ramp it replaces would have a very high flux density at about the time the pulse ends and the field collapses. Bevel 53 curves the flux field out into space, reducing the force on the armature at this critical time.

The second feature shown in FIG. 1A is that the pole face 54 is in fact not a plane surface, but is slightly convex. More particularly, from the edge of bevel 53 back, it is machined to a slight curve (i.e., a large radius r). This also is believed to open up the flux field slightly, but is further felt to (1) increase power at the beginning of the stroke, and (2) facilitate a very rapid collapse of the field at the end of the power pulse.

Figure 4:
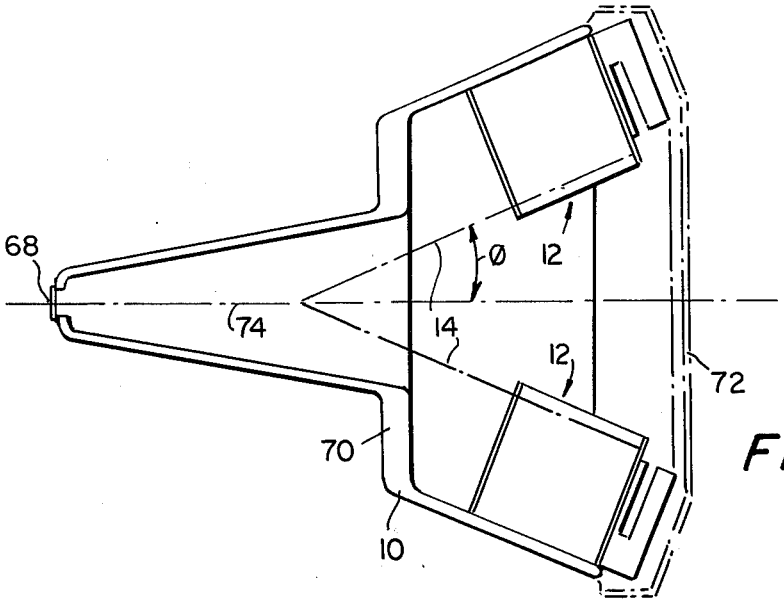
FIG. 4 is a top view of the printing head of the same general type as FIG. 3.

Housing 10 is best illustrated in FIGS. 3 and 4, and attention is directed thereto. Again, non-magnetic materials are necessary, and aluminum and magnesium are preferred. On the other hand, if cost is more important than weight, a precision zinc die casting would be perfectly satisfactory.

Housing 10 is, roughly, one-half of a cone, with the print wire aperture 68 at its apex, an intermediate mounting shoulder 70 eliminating waste space (and unnecessary mass), and having individual electromagnet assemblies 12 mounted around its periphery at the base. A removeable cover 72 is provided for access to the interior.

By placing each electromagnet 12 in a parabolic array around the print axis 74, each printing wire is at precisely the same angle to the print axis 74. While this arrangement is preferred for electromagnets of the dimensions and design set forth hereinabove, it will be appreciated that in larger or smaller units, other designs could be employed. Thus, if even greater spacing between electromagnets was desired, the housing 10 could have a general cone shape rather than half of a cone. In a very small unit, where much closer spacing could be tolerated without creating heat dissipation and cross-talk problems (the latter being the product of overlapping and interacting magnetic fields), a different solution is apparent. More particularly, housing 10 would look like the housing of FIG. 4 from the top, but with s smaller angle $\phi$, and electromagnets 12 could be side-by-side on flat side walls, for example four on a side in an eight-wire array.

Of course, in any embodiment, suitable means (not shown) must be provided for mechanical mounting and electrical connection within the printer.

As noted hereinabove, the joinder or print wire 14 to armature 18 has been a problem in terms of reliability in prior art print heads; this has been the weak link that has been the first to go as the machine seeks to tear itself apart. This problem is overcome in the present invention, in the first instance, because no effort is made to join the extremely refractory print wire metal, generally a tungsten alloy, and the ferrite or other magnetic material from which armature 18 is fabricated. Rather, print wire 14 is joined to machine screw 26. Screw 26, typically manufactured of an alloy steel, is provided with a bore 76 dimensioned for an interference or shrink fit with printing wire 14. When wire 14 is inserted into bore 76, an ideal arrangement for electrical resistance welding is presented: electrodes are clamped to the two workpieces, resulting in the weld-zone 78. Depending on specific compositions of the workpieces, an inert atmosphere should be provided during welding. Testing to destruction of welds made in the foregoing manner indicated that the weld 78 was stronger than wire 14.

Machine screws 24, 26, 28, 30 and 44 are all threadably engaged with magnetic material. While the structural and machining properties of most such materials are sufficient to form high-quality threads, there are instances (e.g. ferrites, laminated cores) where this would not be practical. In such a case, other options are available. If a core or armature is to be manufactured by powder metallurgical techniques, threaded steel inserts mechanically locked therein can be provided ab initio. In the case of laminated cores, individual laminations can be provided with apertures and locking grooves for a steel insert having a threaded bore, which is inserted during lamination.

Figure 5:
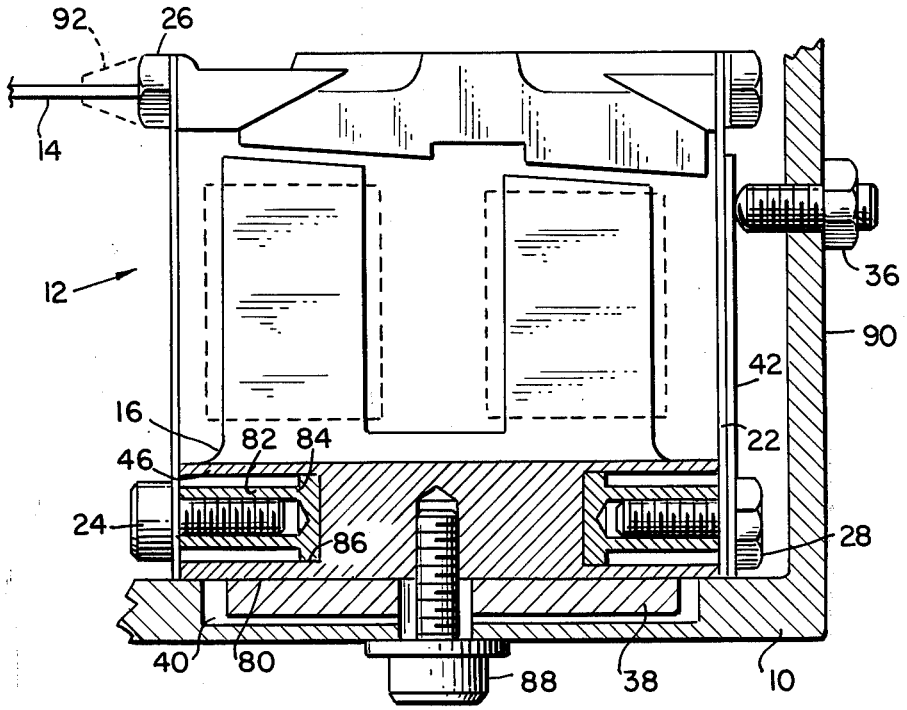
FIG. 5 is an elevation view, partly in section of an alternative embodiment of the electromagnet assembly of the invention.

While the electromagnet assemblies of FIGS. 3 and 4 are preferred, alternaive embodiments are possible: The keel 38 may be integral with the base portion 46 of pole piece 16, reducing the function of saddle 32 to retaining flexure 22, damper tab 42 and adjust screw 36. Further, saddle 32 could also be integral with pole piece 16, but this would require additional machining, would increase mass, and could have adverse magnetic effects. A still further alternative is illustrated in FIG. 5, and attention is directed thereto.

In this embodiment, pole piece 16 may be of laminated construction. Keel 38 is integral with base 46 of pole piece 16, an expedient effected by stamping certain of the laminae in a die adapted for same; keel 38 and slot 40 need only be thick enough to provide guidance while adjusting the assembly, support therefore being provided by shoulder 80. In this embodiment, saddle 32 is entirely eliminated, and machine screw 28 retains only flexure 22 and damping tab 42, which may be any material of choice. Appropriate laminae are also stamped to provide an aperture 82 into which a steel threaded insert 84 is inserted upon assembly, and the latter includes a locking ring 86. A threaded bolt 88 is used to secure the assembly to base 10. In this embodiment, the adjust screw 36 is mounted on an extension 90 of base 10, so that it is effectively in the same position as in the FIG. 3 and 4 embodiment.

A still further alternative involves the elimination of screws 24, 28 and 88 and the mounting of electromagnets 12 on a single threaded rod (not shown) extending between extension 90 (FIG. 5) and shoulder 70 (FIG. 4), which would have to be modified to receive the rod. Such an embodiment would still have the keel 38 and slot 40 for firm support and lateral positioning, but longitudinal positioning, i.e., for fine adjustment of the print wire end, could be done externally by loosening restraining nuts and turning the rod.

Those skilled in the art will also appreciate that while the present invention has been described with reference to dot matrix printing, the electromagnets 12 have application in other types of printing. More particularly, and referring again to FIG. 5, the print wire 14 and bolt 26 can be replaced with a hardened steel, truncated cone-headed bolt 92, with the result that the device could be employed as a hammer or character printer of the type described hereinabove.

Various other changes in the details, steps, materials and arrangement of parts, which have herein been described and illustrated to explain the nature of the invention, may be made by those skilled in the art within the principle and scope of the invention as defined in the appended claims.

What is claimed is:

1. An electromagnet assembly for a dot matrix print head comprising:

an armature;

flexure means secured to the end of said armature and supporting same for movement from a rest position to a printing position and back without angular change during movement;

a single, generally U-shaped magnetizable core member having a base and a pair of legs extending toward said armature, the ends of said legs forming a first pair of pole faces;

said flexure means also being secured to the respective ends of said base;

said pole faces being adjacent said armature and each forming an identical acute angle in the range of 7 to 26 degrees with the axis thereof;

a second pair of magnetizable pole faces on said armature and at the same angle to said axis as said first of pole faces and defining therebetween a pair of closable air gaps;

coil means on each leg of said core member, energizing of said coil means creating a magnetic field between said pairs of pole faces and moving said armature to close said gaps; and print wire means secured to an end of said armature and adapted to be pushed thereby to a printing position on energizing of said coils.

2. The electromagnet assembly as claimed in claim 1, wherein said flexure means comprise a pair of flat, parallel spring elements.

3. The electromagnet assembly as claimed in claim 1, wherein said first pair of pole faces is shaped to be slightly convex.

4. The electromagnet assembly as claimed in claim 3, wherein the upper edge of said first pair of pole faces is shaped to have a small bevel.

5. The electromagnet assembly as claimed in claim 1, and additionally comprising means on said core member for securing same in a print head.

6. The electromagnet assembly as claimed in claim 1, and additionally comprising a screw member, the end of said print wire being secured in a bore in said screw member, said screw member being threaded into an end of said armature, said screw member also securing one of said flexure means against said armature.

7. The electromagnet assembly as claimed in claim 2, and additionally comprising stop means adjoining one said spring element in the rest position and adapted to dampen return motion of said armature.

8. The electromagnet assembly as claimed in claim 1, wherein said flexure means are sized so that vertical motion of said print wire, upon moving horizontally from said rest position to said printing position, is less than the radius of said wire.

9. The electromagnet assembly as claimed in claim 1, wherein the center of mass of said armature and the axis of said print wire are coaxial.

10. A print head for a dot matrix printer comprising:

a housing having a nose bearing at one end and side walls of a general half-cone shape;

a plurality of electromagnet assemblies mounted in a parabolic array interiorly around said conical side walls;

each said electromagnet assembly comprising: an armature;

flexure means secured to the ends of said armature and supporting same for movement from a rest position to a printing position and back without angular change during movement;

a single, generally U-shaped magnetizable core member having a base and a pair of legs extending toward said armature, the end of said legs forming a first pair of pole faces;

said flexure means also being secured to the respective ends of said base;

said pole faces being adjacent said armature and each forming an identical acute angle in the range of 7 to 26 degrees with the axis thereof;

a second pair of magnetizable pole faces on said armature at the same angle to said axis as said first pair of pole faces and defining therebetween a pair of air gaps;

coil means on each leg of said core member, energizing of said coil means creating a magnetic field between said pairs of pole faces and moving said armature to close said gaps;

a curved print were extending from each said armature into said nose bearing, all said print wires being of equal length, having identical paths of travel, and also moving without angular change upon energizing of said electromagnet assemblies.

11. The print head as claimed in claim 10, wherein said first pair of pole faces is slightly convex.

12. The print head as claimed in claim 10, wherein said print wire is secured in a bore in a screw, and said screw is threaded into an end of said armature, said screw also securing one of said flexure means against said armature.

13. The print head as claimed in claim 10, wherein said flexure means are sized so that vertical motion of said print wire upon moving horizontally from said rest position to said printing position, is less than the radius of said wire.

* * * * *